US007364477B2

(12) United States Patent
Vance

(10) Patent No.: US 7,364,477 B2
(45) Date of Patent: Apr. 29, 2008

(54) LOW PROFILE CIRCUIT BOARD CONNECTOR

(75) Inventor: Scott LaDell Vance, Cary, NC (US)

(73) Assignee: Sony Ericsson Mobile Communications AB (SE)

( * ) Notice: Subject to any disclaimer, the term of this patent is extended or adjusted under 35 U.S.C. 154(b) by 0 days.

(21) Appl. No.: 10/988,355

(22) Filed: Nov. 12, 2004

(65) Prior Publication Data

US 2006/0105640 A1 May 18, 2006

(51) Int. Cl.
*H01R 4/48* (2006.01)

(52) U.S. Cl. ..... 439/862

(58) Field of Classification Search ..... 439/862, 439/67, 78–81, 66, 77, 329, 83, 535, 71, 439/74, 342, 65; 361/832, 828
See application file for complete search history.

(56) References Cited

U.S. PATENT DOCUMENTS

| | | | | |
|---|---|---|---|---|
| 4,927,369 | A * | 5/1990 | Grabbe et al. | 439/66 |
| 5,462,443 | A * | 10/1995 | Kurbjuhn et al. | 439/78 |
| 5,588,878 | A * | 12/1996 | Flinchbaugh et al. | 439/682 |
| 5,919,051 | A | 7/1999 | Mitra et al. | |
| 6,200,141 | B1 | 3/2001 | Sinclair | |
| 6,293,818 | B1 | 9/2001 | Kim et al. | |
| 6,680,434 | B2 * | 1/2004 | Yeh | 174/50 |
| 6,805,595 | B2 * | 10/2004 | Kukita et al. | 439/862 |
| 6,863,540 | B2 * | 3/2005 | Spykerman | 439/66 |
| 6,896,561 | B2 * | 5/2005 | Lai | 439/862 |
| 6,929,483 | B2 * | 8/2005 | Huang et al. | 439/66 |

FOREIGN PATENT DOCUMENTS

| | | |
|---|---|---|
| EP | 1075049 | 2/2001 |
| EP | 1455416 | 9/2004 |
| FR | 1408382 | 8/1965 |
| GB | 1094014 | 12/1967 |
| WO | WO 03/048788 | 6/2003 |

OTHER PUBLICATIONS

PCT International Search Report, International Application No. PCT/US2005/030211, Dec. 23, 2005.

* cited by examiner

*Primary Examiner*—Edwin A. Leon
(74) *Attorney, Agent, or Firm*—Coats & Bennett, P.L.L.C.

(57) ABSTRACT

A printed circuit board connector has a mounting portion mounted on a first side of a printed circuit board and an elastically biased contact portion extending from the mounting portion. The mounting portion is enlarged for vacuum pick up. The contact portion has a substantially S-shaped cross section and protrudes beyond a second side of the printed circuit board opposite the first side. The connector may be used with a single-sided printed circuit board where the connector provides an electrical coupling from the contact portion beyond the second side of the circuit board to a mounting pad on which the connector is mounted on the first side. The contact portion is elastically deformable from between a first state protruding beyond the second side of the printed circuit board to a second state substantially flush with the second side of the printed circuit board.

14 Claims, 7 Drawing Sheets

LOW PROFILE CIRCUIT BOARD CONNECTOR

BACKGROUND

In the field of electronics, printed circuit boards (PCBs) provide a compact structure for packaging electrical components and circuits. PCBs are commonly used in electronic assemblies, so it is typically the case that electrical signals are conveyed between the PCBs and other components of a larger assembly. To that end, multi-pin connectors provide one mechanism for establishing an electrical coupling to traces on the PCB for the purpose of transmitting signals to and from the PCB. Multi-pin connectors provide an advantage of packaging a relatively large number of signal conduits in a small volume. In other cases, it is also necessary to provide point connectivity to a relatively small number of traces on a PCB. For example, a single contact is sometimes used to connect a PCB to an antenna or to a reference voltage such as ground. In these cases, it is sometimes feasible or necessary to use a single contact that couples the PCB to a separate component in the electronic assembly.

A variety of solutions are known for providing point-contact connectivity to a PCB. Leaf springs and coil springs are examples of the types of contacts used for this purpose. In fact, leaf springs and coil springs are also used in multi-pin connectors, which may simply be thought of as a conglomeration of point-contact connections. These individual contacts are often spring biased to help establish sufficient contact force between conducting surfaces and improve electrical connectivity. Unfortunately, coil springs and leaf springs are not always preferable for certain applications. As an example, coil springs are generally characterized by high impedances at RF frequencies making them impractical for use with antennas.

Leaf springs offer a viable alternative to coil springs, particularly for use in conveying high frequency signals. Leaf-spring contacts are known in the art and are generally available off the shelf. However, certain disadvantages are present with existing solutions. For instance, many existing leaf spring contacts have a limited spring range, making them impractical for use where an electrical connection needs to be established between the PCB and a component that is positioned a relatively large distance away from the PCB. This situation would seem ideally suited for a coil spring were it not for the impedance limitations discussed above.

Furthermore, many leaf spring contacts have a large pick-up surface for lifting and placing the contact on a PCB or into an assembly. This pick-up surface is particularly required where a vacuum pick-up is used to place the contact during assembly. With conventional leaf spring contacts, the enlarged pick-up surface is placed at a distal end of the contact opposite the mounting surface (i.e., where the contact is mounted to the PCB or other component). Thus, the pick-up surface also functions as a connection surface once the contact is placed in the electronic assembly. Some disadvantages to this configuration include that the contact can be quite large and that the connecting surface is flat. A flat surface is not always optimal as a contact surface. In certain instances, it may be desirable to have a coined or shaped contact surface to control the characteristics of the electrical interface.

Another disadvantage of existing leaf spring contacts pertains to the elasticity of the contact. Spring biased contacts have a characteristic resiliency and the internal reaction forces caused by deflection of the contact help establish sufficient physical contact and electrical connectivity between electrical components. These reaction forces are an inherent property of the contact that are repeatable as long as the contact substantially retains its original shape. Certain factors that can adversely affect the shape of the contact include creep, fatigue, and plastic deformation. Creep and fatigue are often produced in high temperature, high stress environments and can generally be avoided by proper design and selection of the contact. Plastic deformation tends to change the shape of the contact and often occurs during assembly or use when the contact is deflected beyond the yield point of the base material. In layman's terms, the contact is bent so that it no longer makes sufficient, if any, contact between electrical components. In existing applications, a dedicated stop is generally required to limit deflection and prevent over-compression of a contact.

SUMMARY

The present invention is directed to a PCB contact adapted to provide electrical connectivity between an electrical component and a PCB. An exemplary embodiment of the PCB contact is a one-piece construction having a mounting portion and a contact portion. The contact may be mounted on a printed circuit board with the mounting portion adapted to be mounted on a first side of the printed circuit board and the elastically biased contact portion extending from the mounting portion and protruding beyond a second side of the printed circuit board opposite the first side. The mounting portion may be generally flattened and enlarged for vacuum pick-up, such as for assembly or mounting to a circuit board. In one embodiment, the mounting portion may be adapted for soldering to a surface mount circuit board.

The contact portion extends through or around the circuit board from the mounting portion a distance at least as large as the thickness of the circuit board. The contact portion is elastically deformable and may pass through an aperture or slot in the circuit board or around a side of the circuit board. The elastically biased contact portion may comprise a cross section that is substantially S-shaped. Further, the contact portion may also have a coined contact surface. Since the contact portion protrudes beyond the side of the PCB opposite the mounting portion, the PCB contact may be particularly suited for use on a single sided circuit board.

The contact may advantageously provide an electrical coupling from the contact portion beyond the second side of the circuit board to the mounting pad on the first side. An electrical component may be placed in physical contact with the PCB contact and compress the contact portion. The elasticity of the contact portion allows the deflection force to be applied in different directions, including in a direction substantially perpendicular to the second side of the printed circuit board. Also, where the contact portion protrudes beyond the opposite side of the mounting portion, the contact portion may be elastically deformable between a first extended state to a second compressed state substantially flush with the second side of the printed circuit board. As a result, the second side of the printed circuit board thus operates as a stop limiting deflection of the contact to elastic deflection, which helps prevent damage potentially caused by excessive compression of the contact.

DETAILED DESCRIPTION

Figure 1:
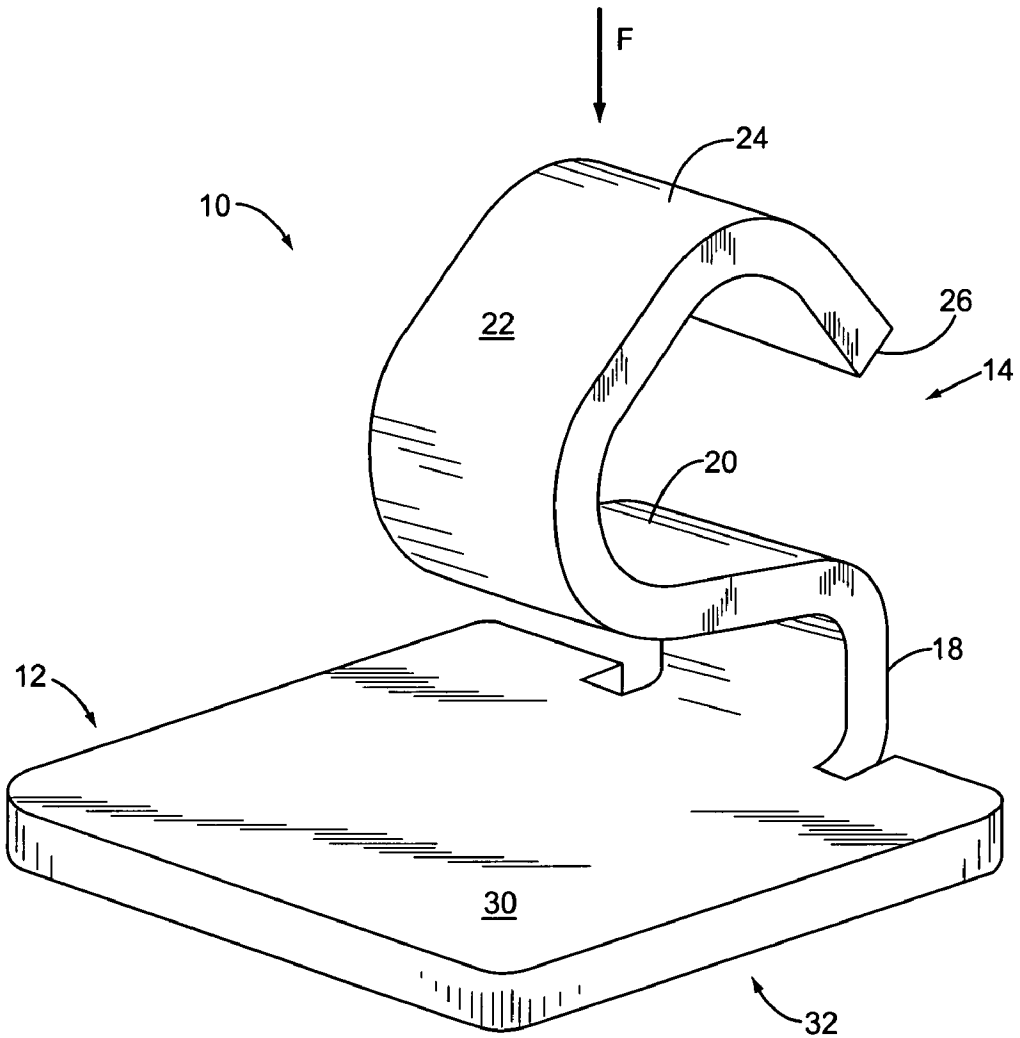
FIG. 1 is a perspective view of a PCB contact according to one embodiment of the present invention.

The present invention relates to a printed circuit board (PCB) contact adapted to provide electrical connectivity to one or more electrical traces or planes on a PCB. The contact may be installed on a PCB that is itself installed in a larger electronics assembly such as a mobile wireless device, radio device, handheld electronic device, or any other suitable wired or wireless device. FIG. 1 shows one embodiment of a PCB contact 10 suitable for this purpose. The PCB contact 10 is a relatively thin conductive device that has a mounting portion 12 and a contact portion 14 extending from the mounting portion 12. In one embodiment, the contact 10 has a substantially uniform thickness of approximately 0.2 millimeters, though it should be understood that other sizes may be appropriate depending on the details of a particular application and the strength of the contact material. Suitable contact 10 materials may include alloys of copper, brass, beryllium copper, stainless steel, and other conductive contact materials known to those skilled in the art. In one embodiment, the contact is constructed of a phosphor bronze material.

The mounting portion 12 is generally flat and enlarged to provide a surface suitable for vacuum pick-up. That is, the mounting portion 12 is sufficiently large to allow a vacuum pick-up to lift and place the PCB contact 10 into an assembly such as on a PCB. A first surface 30 of the mounting portion 12 faces the direction of contact portion 14. A second, opposing surface 32 faces away from the contact portion 14.

The contact portion 14 has a generally S-shaped cross section. A first part 18 of the contact portion 16 extends from the mounting portion 12. The first part 18 of the contact section protrudes generally vertically from the mounting portion 12 and transitions into a generally horizontally disposed intermediate part 20 of the contact portion. The intermediate part 20 traverses a path extending from the first part 18 near the edge of the mounting portion 12 and towards the center of the mounting portion 12 where the intermediate part 20 transitions to a second part 22. The second part 22 of the contact portion 14 has a substantially arcuate shape that extends from the intermediate part 20 away from the mounting portion 12 towards an apex at the contact surface 24 and to an end 26 that slopes down towards the mounting portion 12. In general, the contact portion 14 may extend above the mounting portion substantially within an envelope defined by the perimeter of the mounting portion 12.

This S-shaped cross section of the contact portion 14 may provide several advantages. On the one hand, the shape of the contact portion 14 spans a relatively large distance relative to the size of the contact 10 thus providing connectivity between a component and a PCB that are spaced apart. In addition, the shape of the contact portion improves the elasticity of the contact portion 14, allowing the contact portion 14 to deflect in the direction of contact force F, which may be in a direction other than strictly perpendicular to mounting portion 12. In other words, the contact surface 24 may deflect in the direction of contact force F without any unnecessary or undesirable lateral sliding deflection. As a result, when a component (not explicitly shown in FIG. 1) is placed in physical contact with the contact surface 24, the contact portion 14 may compress, but the connection between the contact surface 24 and the component potentially remains consistently stable. Furthermore, the compression of contact portion 14 creates an equal but opposite reaction force that tends to maintain contact between the contact surface 24 and the component.

Other embodiments of the contact portion 14 are certainly feasible. Design constraints may dictate that the contact portion 14 extend laterally outside the envelope above the mounting portion 12. Similarly, the shape of the contact portion 14 may assume a form other than the S-shape portrayed in the embodiments shown in the Figures. Thus, the embodiment shown in the Figures represents a single compact solution.

Figure 2:
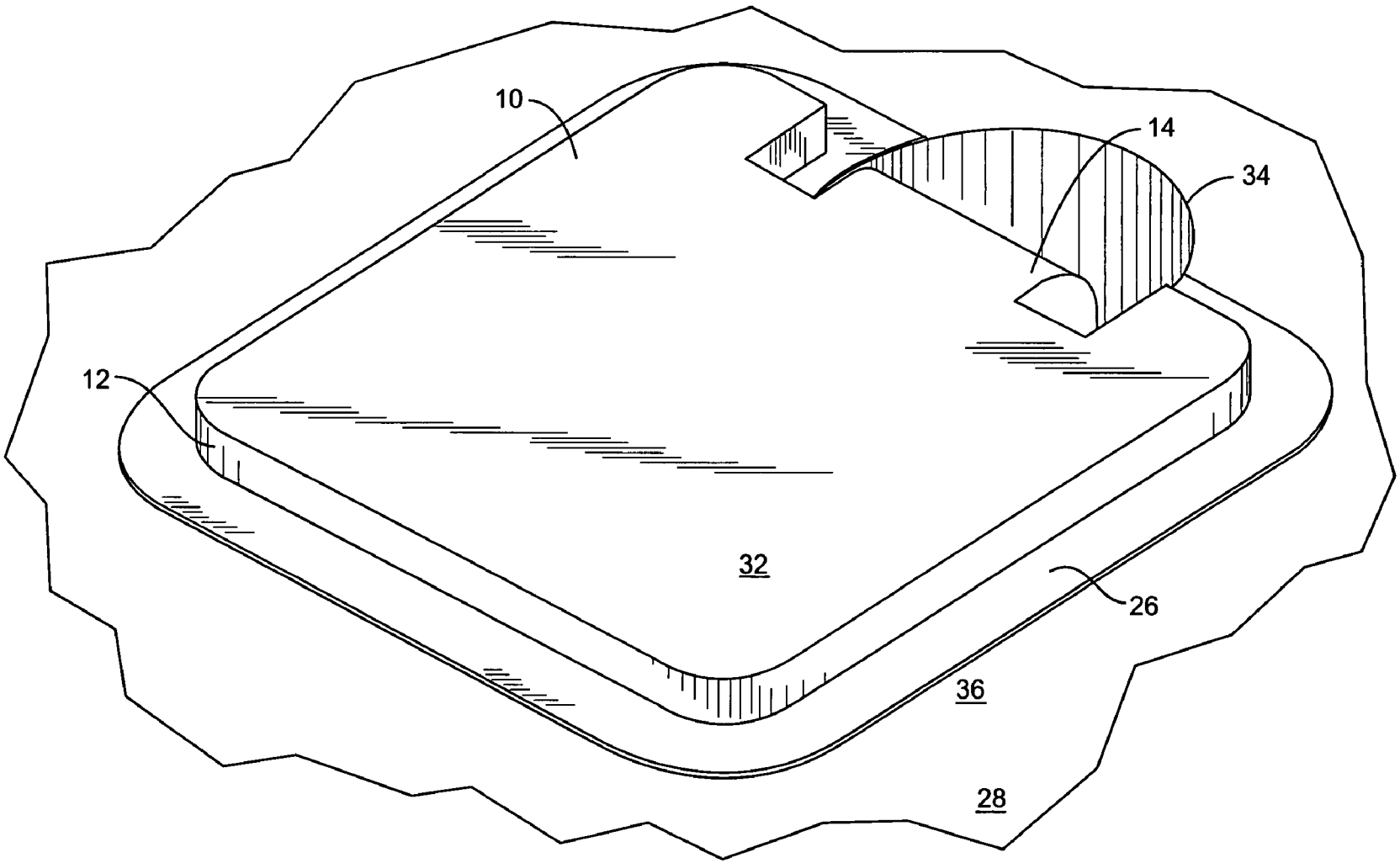
FIG. 2 is a partial perspective view of an installed PCB contact according to one embodiment of the present invention.

FIG. 2 shows the contact 10 mounted on a pad 26 located on a first side 36 of a PCB 28. PCB 28 may be a surface mount board or a conventional through-hole board. Pad 26 may be connected to a trace or grounding plane (not shown) in the PCB 28. In FIG. 2, the contact 10 is oriented upside down compared to the orientation shown in FIG. 1. Thus, first surface 30 of mounting portion 12 is positioned in contact with pad 26 while second surface 32 of mounting portion 12 is exposed. With this orientation, second surface 32 may advantageously provide a surface by which a vacuum pick-up may lift and place the contact 10 onto pad 26 of PCB 28.

Figure 3:
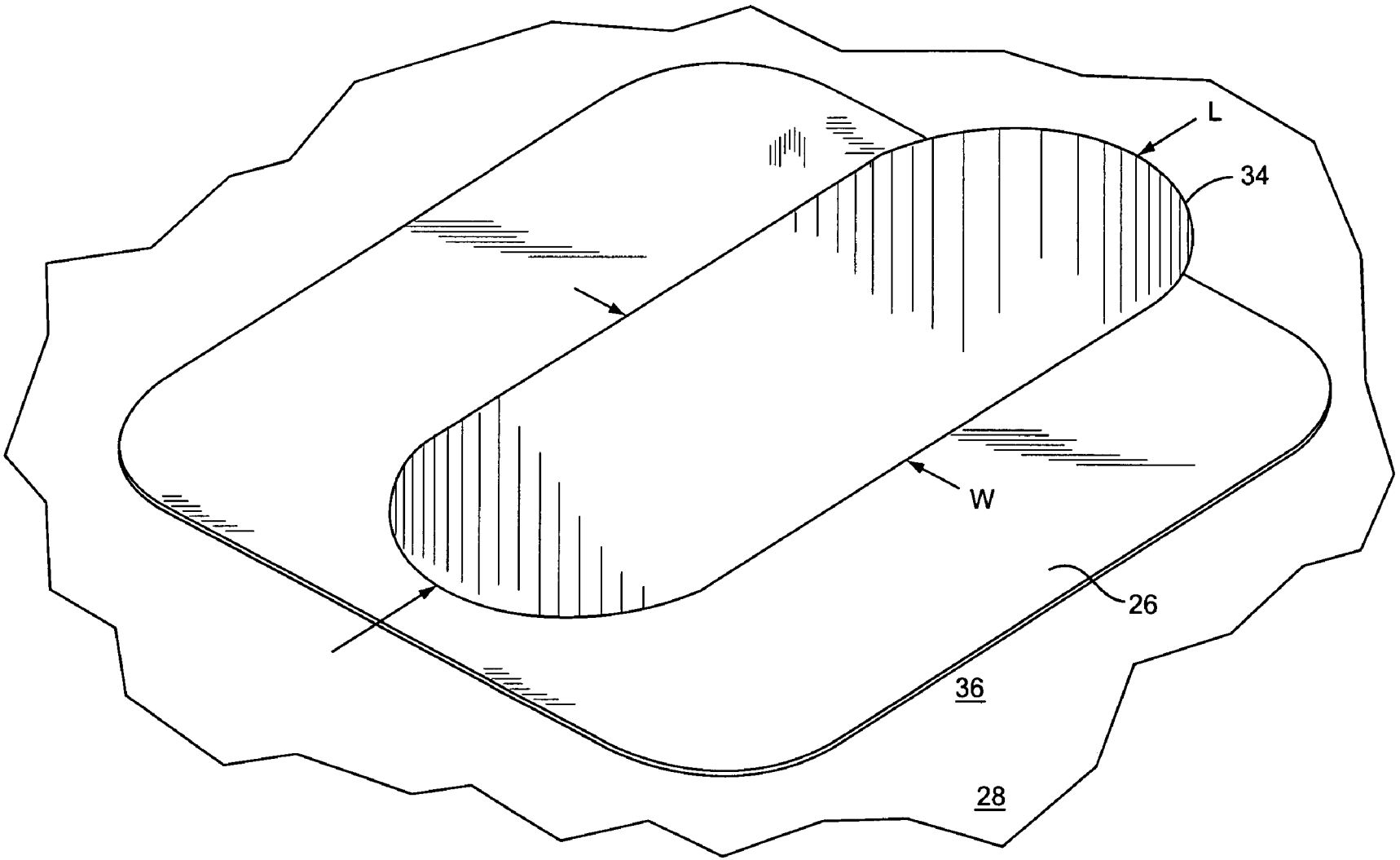
FIG. 3 is a partial bottom perspective view of a PCB adapted for use with a PCB contact according to one embodiment of the present invention.

The contact portion 14 of contact 10 is positioned within an aperture 34 in the PCB 28. A clear view of the pad 26 and aperture 34 in PCB 28 are shown in FIG. 3, where the contact 10 is removed for clarity. In the embodiment shown, the aperture 34 has a generally slotted configuration where the length L of the slot is greater than the width W of the slot. In one embodiment, the width W of the slot is about 1 millimeter and the length L of the slot is about 4 millimeters. The slotted aperture 34 provides an open volume in which the contact portion 14 (see FIG. 2) is placed. The shape of the aperture 34 may certainly be altered as needed. For instance, a rectangular or circular shape may also be used.

Figure 4:
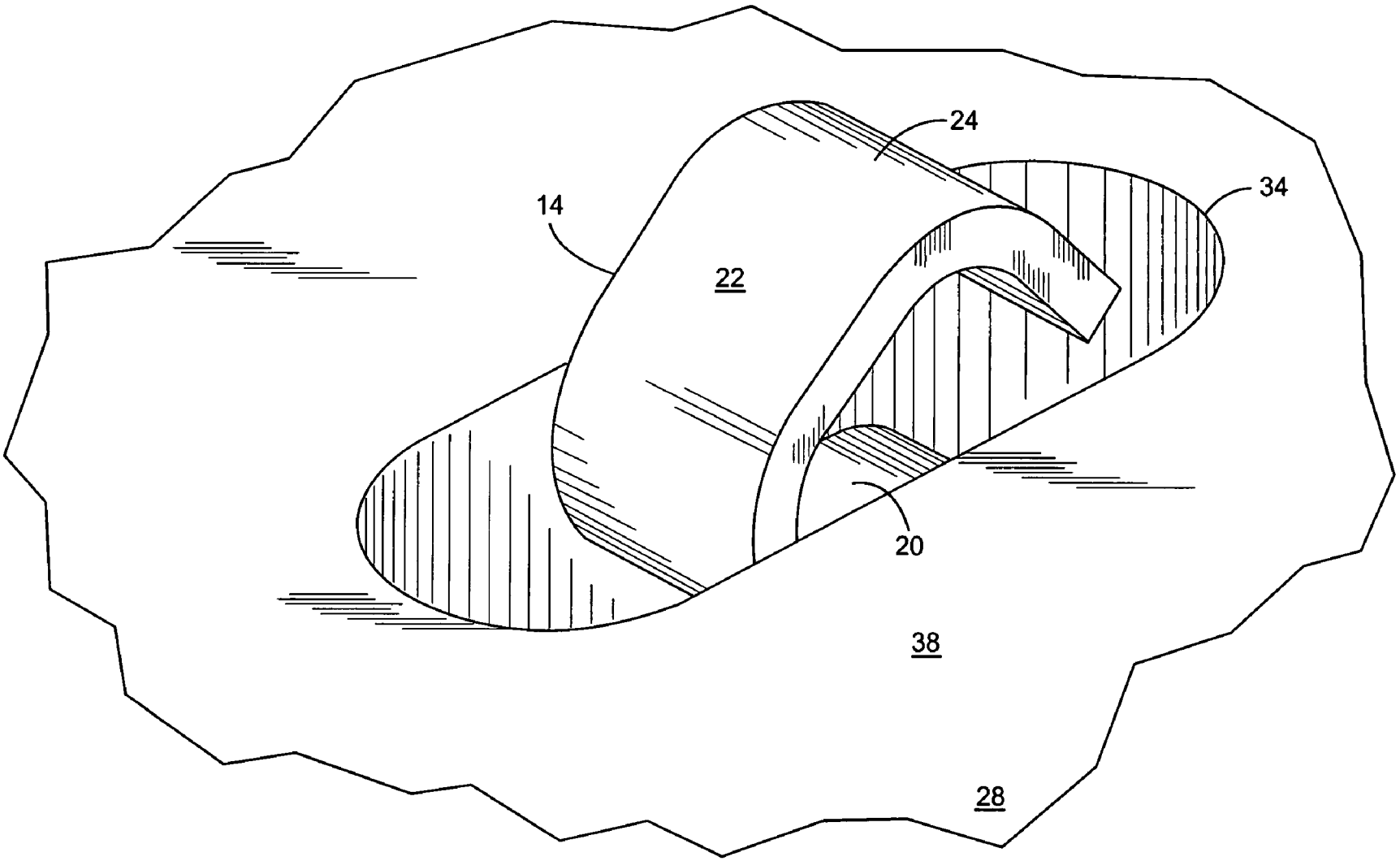
FIG. 4 is a sectioned partial perspective view of an installed PCB contact according to one embodiment of the present invention.
Figure 5:
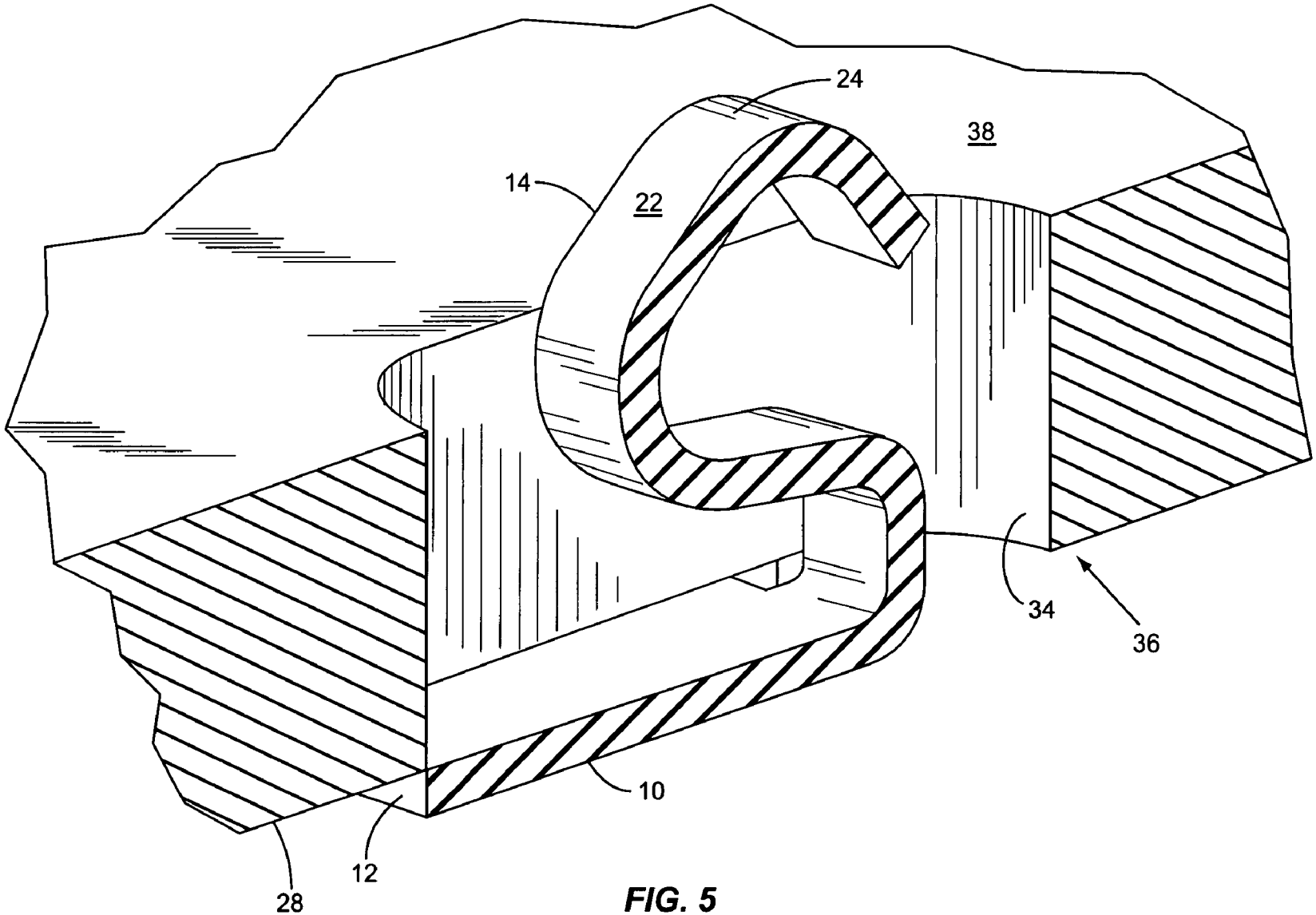
FIG. 5 is a partial perspective view of a PCB mounting configuration for a PCB contact according to one embodiment of the present invention.

Aperture 34 extends through the PCB to allow the contact portion 14 to protrude beyond the opposite second side 38 (i.e., opposite first side 36 and mounting pad 26) of the PCB 28 as shown in FIGS. 4 and 5. FIG. 5 includes a perspective section view illustrating the contact portion 14 positioned within the PCB aperture 34. In the embodiment shown in FIGS. 4 and 5, the contact surface 24 is located approximately 0.8 mm above side 38. With this configuration, the contact surface 24 is exposed and accessible from the second side 38 of the PCB 28 while the mounting portion 12 is coupled to the mounting pad 26 on the first side 36 of the PCB. With the contact portion 14 positioned within aperture 34 as shown in FIGS. 4 and 5, an electrical component (not shown) may be placed in electrical contact with contact surface 24. Also, the component may be positioned sufficiently close to the PCB so that contact portion 14 compresses into the aperture 34. The risk of over-compression of contact 10 with this configuration is minimized because even where an electrical component and the PCB 28 are pushed (inadvertently or otherwise) into contact with each other, the contact portion 14 may deflect only to the point where contact surface 24 is flush with second side 38.

Figure 6:
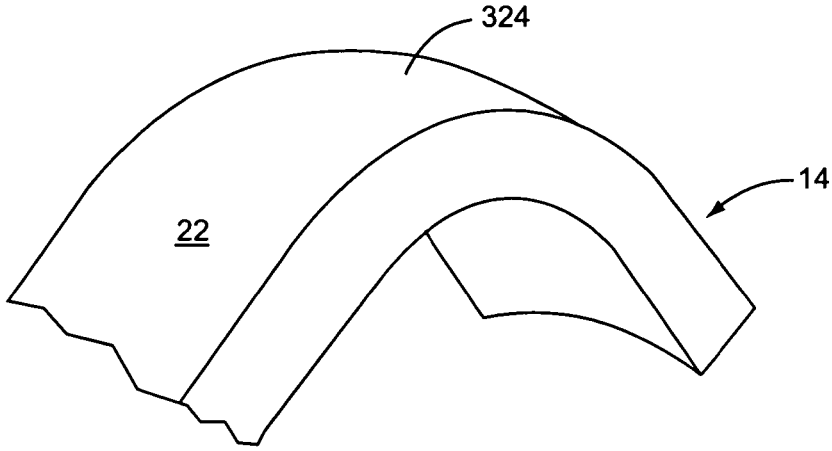
FIG. 6 is a partial perspective view of a PCB contact according to one embodiment of the present invention.

In the embodiment of the POB contact 10 shown in FIGS. 1, 4, and 5, the contact surface 24 is distributed substantially evenly across the width of the second part 22 of contact portion 14. That is, the contact surface 24 has a substantially linear engagement surface. It may be desirable to include variations of this contact surface 24. For instance, as shown in FIG. 6, contact portion 14 may be formed into a concavo-convex surface such that the engagement area at contact surface 24 is substantially reduced to a point or circular contact surface 324.

In other embodiments, the contact surface 24 may be coined into a particular shape. In this context, a coined surface may be formed into a particular shape using a coining, stamping, pressing, rolling or other manufacturing operation. Those skilled in the art will appreciate the various methods of shaping a contact surface for improved connection characteristics. By way of non-limiting example, two alternative contact surfaces 124 and 224 are shown in FIGS. 7 and 8, respectively.

Figure 7:
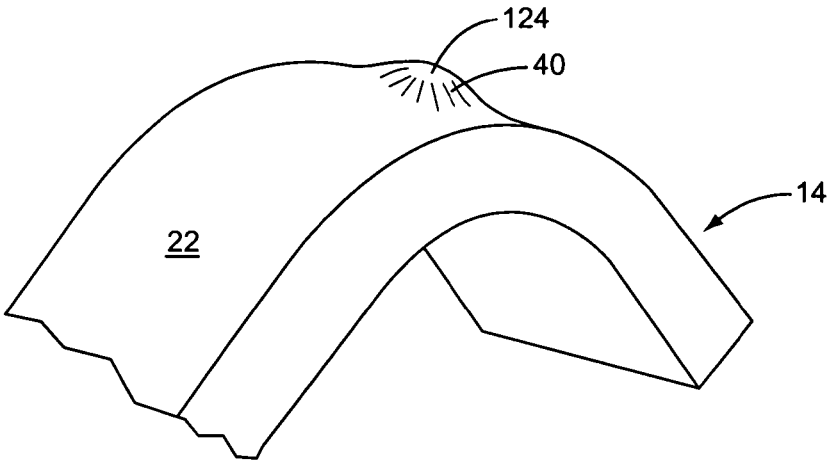
FIG. 7 is a partial perspective view of a PCB contact according to one embodiment of the present invention.
Figure 8:
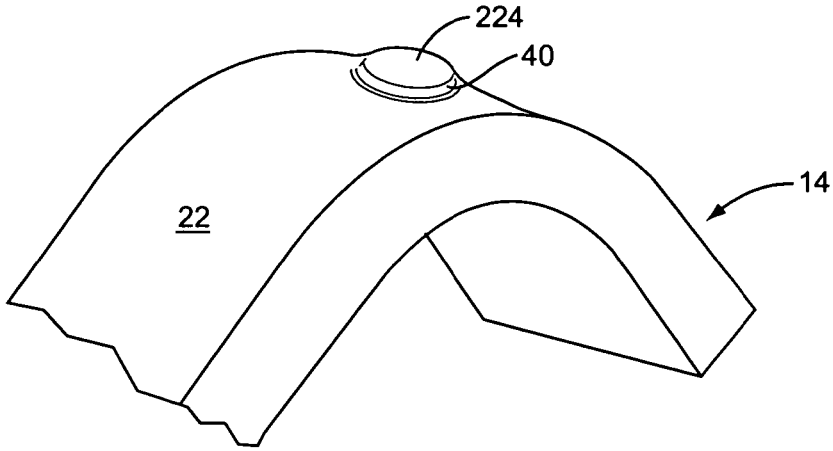
FIG. 8 is a partial perspective view of a PCB contact according to one embodiment of the present invention.

In FIG. 7, the contact surface 124 is located atop an area 40 that is raised relative to the remainder of the second part 22 of contact portion 14. Consequently, the contact surface 124 is reduced to a small area of contact, perhaps even a point contact depending on the nature of the raised area 40. In FIG. 8, a similar raised area 40 is formed under the contact surface 224. However, contact surface 224 is formed into a relatively flat elliptical or circular area. In each case, contact surface 124 and 224 provides a controlled area of connectivity which can aid a designer in predicting signal transfer characteristics.

Figure 9A:
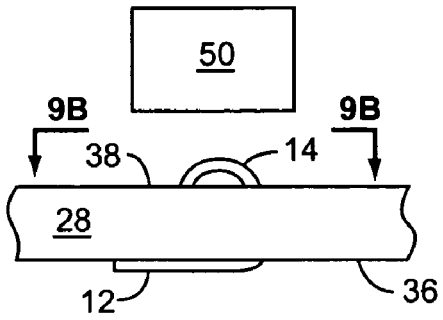
FIGS. 9A and 9B are partial side and partial plan views, respectively, of a PCB contact assembly according to one embodiment of the present invention.
Figure 9B:
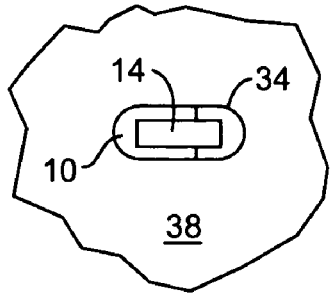
Figure 10A:
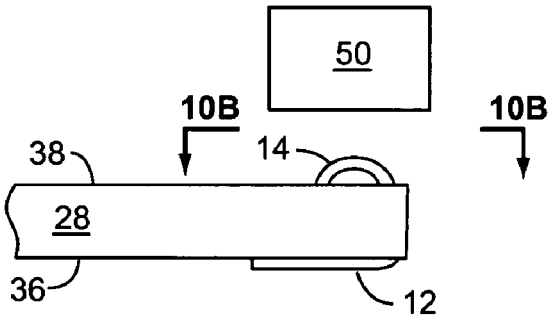
FIGS. 10A and 10B are partial side and partial plan views, respectively, of a PCB contact assembly according to one embodiment of the present invention.
Figure 10B:
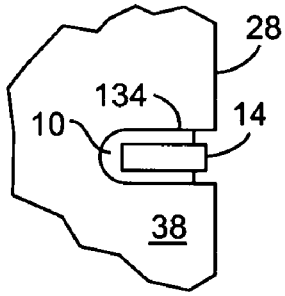

In the embodiments of the PCB contact 10 and PCB 28 heretofore described, the contact 10 is installed within an aperture 34 that is spaced away from an edge of the PCB 28. This configuration is portrayed again in FIGS. 9A and 9B, where aperture 34 and PCB contact 10 are positioned at some undetermined location in the interior of PCB 28. FIG. 9A also shows an electronic component 50, which may be placed in contact with contact portion 14 to establish an electrical connection to mounting portion 12 and to PCB 28. Notably, component 50 and mounting portion 12 are disposed on opposite sides of PCB 28. Mounting portion 12 is mounted on a first side 36 of PCB 28 while electronic component 50 is positioned above second side 38. Also, as is shown in FIG. 9B, aperture 34 is a closed feature, wholly contained within the interior of PCB 28. In contrast, an alternative embodiment shown in FIGS. 10A and 10B includes an aperture 134 that is disposed near an edge of the PCB 28 to form an open-sided slot. This particular embodiment may advantageously use less area on the PCB 28.

Figure 11A:
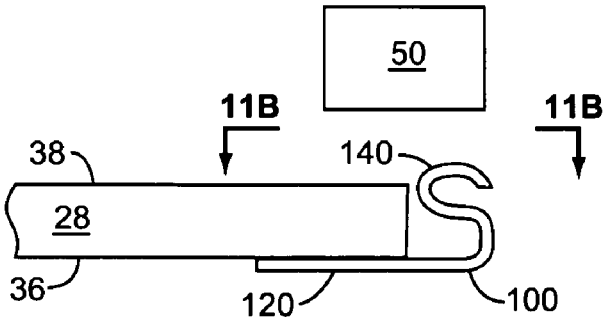
FIGS. 11A and 11B are partial side and partial plan views, respectively, of a PCB contact assembly according to one embodiment of the present invention.
Figure 11B:
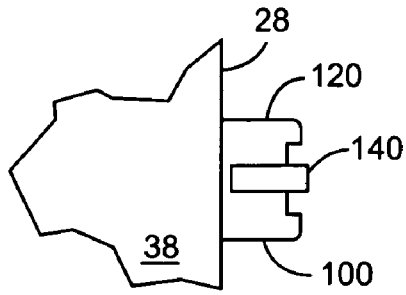

Further, as is shown in FIGS. 11A and 11B, an alternative embodiment of PCB contact 100 may be positioned near the edge of a PCB 28 that does not have an aperture. The contact portion 140 may be routed around the edge of a PCB 28 from the mounting portion 120 on one side 36 of the PCB 28 to a component 50 on the opposing side 38 of the PCB 28. This particular embodiment requires added space beyond the perimeter of the PCB 28, but may be advantageously applicable to existing products, thus potentially eliminating redesign, retooling, and scrap.

The present invention may be carried out in other specific ways than those herein set forth without departing from the scope and essential characteristics of the invention. For instance, the contact portion 14, 140 may be constructed with fewer or more bends than that illustrated in the Figures. As a non-limiting example, the contact portion 14, 140 may have a single bend and thus have a substantially C-shaped cross-section. Similarly, the bends may be characterized by more or less gradual transitions. Thus, a Z-shaped contact portion is also certainly within the intended scope of the present invention. The present embodiments are, therefore, to be considered in all respects as illustrative and not restrictive, and all changes coming within the meaning and equivalency range of the appended claims are intended to be embraced therein.

What is claimed is:

1. A printed circuit board connector system comprising:

a printed circuit board having a solder pad disposed on a first side of the printed circuit board and further having a closed aperture, the aperture passing through the printed circuit board from the first side to a second side of the printed circuit board opposite the first side;

a connector having a mounting portion adapted to be mounted to the solder pad and a contact portion extending from the mounting portion, the contact portion protruding through the aperture beyond the second side of the printed circuit board, substantially the entire contact portion being elastically deformable from between a first state protruding beyond the second side of the printed circuit board to a second state substantially flush with the second side of the printed circuit board; and a component disposed beyond the second side of the printed circuit board in contact with the contact portion.

2. The system of claim 1 wherein the mounting portion is substantially flat.

3. The system of claim 1 wherein the mounting portion is enlarged for vacuum pick up.

4. The system of claim 1 wherein the aperture passes through the solder pad.

5. The system of claim 1 wherein the contact portion comprises a cross section that is substantially S-shaped.

6. The system of claim 1 wherein the contact portion comprises a coined contact surface.

7. The system of claim 1 wherein the printed circuit board is single-sided and the connector provides an electrical coupling from the electrical component beyond the second side of the circuit board to the solder pad on which the connector is mounted on the first side.

8. The system of claim 1 wherein the printed circuit board is a surface mount board.

9. A surface mount connector comprising:

a mounting portion comprising a vacuum pick-up surface, the mounting portion adapted to be mounted to a surface mount pad on a circuit board, the circuit board having a thickness in a direction perpendicular to the circuit board at the pad; and a contact portion extending through the circuit board from the mounting portion a first distance in the perpendicular direction at least as large as the thickness of the circuit board, the contact portion being elastically deformable at least in the perpendicular direction, the contact portion including a substantially S-shaped configuration with a plurality of flex points.

10. The connector of claim 9 wherein the mounting portion has a perimeter defining an envelope that is wider than the contact portion extending through the circuit board.

11. The connector of claim 9 wherein the plurality of flex points are disposed within a second distance measured in the perpendicular direction from the mounting portion, the second distance being less than or equal to the thickness of the circuit board.

12. The connector of claim 9 wherein the vacuum pick-up surface faces away from the contact portion.

13. The connector of claim 9 wherein the connector is adapted to be mounted to a single sided circuit board.

14. The connector of claim 9 further comprising a coined contact surface on the contact portion.

* * * * *

UNITED STATES PATENT AND TRADEMARK OFFICE

CERTIFICATE OF CORRECTION

PATENT NO. : 7,364,477 B2
APPLICATION NO. : 10/988355
DATED : April 29, 2008
INVENTOR(S) : Vance It is certified that error appears in the above-identified patent and that said Letters Patent is hereby corrected as shown below:

In Col. 5, line 9, change "POB" to --PCB--.

Signed and Sealed this

Twenty-ninth Day of July, 2008

JON W. DUDAS
*Director of the United States Patent and Trademark Office*